US007198265B2

(12) United States Patent
Chelvayohan et al.

(10) Patent No.: US 7,198,265 B2
(45) Date of Patent: Apr. 3, 2007

(54) IMAGING APPARATUS INCLUDING A MOVABLE MEDIA SENSOR

(75) Inventors: Mahesan Chelvayohan, Lexington, KY (US); Brian Dale Cook, Nicholvasville, KY (US); Timothy Lorn Howard, Lexington, KY (US); Kevin Matthew Johnson, Georgetown, KY (US); William Scott Klein, Richmond, KY (US); Michael William Lawrence, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 28 days.

(21) Appl. No.: 10/930,446

(22) Filed: Aug. 31, 2004

(65) Prior Publication Data

US 2006/0071391 A1 Apr. 6, 2006

(51) Int. Cl.
*B65H 7/14* (2006.01)

(52) U.S. Cl. ..... 271/110; 271/10.02

(58) Field of Classification Search ..... 271/110, 271/153, 3.15, 10.02, 4.02, 104, 25, 31, 38; 250/559.04, 559.16, 559.17, 559.18; 464/45; 192/56.6, 56.2

See application file for complete search history.

(56) References Cited

U.S. PATENT DOCUMENTS 2,737,274 A * 3/1956 Mouravieff ..... 192/41 R
3,335,835 A * 8/1967 Conlon ..... 192/81 R
3,618,721 A * 11/1971 Hare ..... 192/35
3,893,554 A * 7/1975 Wason ..... 464/40
3,968,364 A * 7/1976 Miller ..... 250/237 R
4,465,171 A * 8/1984 Koyama ..... 192/84.81
4,560,050 A * 12/1985 deMey, II ..... 192/81 C
4,687,352 A * 8/1987 Igi et al. ..... 400/73
4,690,577 A * 9/1987 Kikuchi et al. ..... 400/708
4,707,138 A * 11/1987 Coatney ..... 356/402
4,971,311 A * 11/1990 Tsukimoto ..... 271/227
5,132,531 A * 7/1992 Duncan et al. ..... 250/231.13
5,143,510 A * 9/1992 Takamura et al. ..... 414/796.7
5,171,980 A * 12/1992 Marzullo et al. ..... 250/223 R
5,174,562 A * 12/1992 Mizunaga et al. ..... 271/261
5,181,801 A 1/1993 Durler
5,297,880 A * 3/1994 Kawanishi et al. ..... 400/703
5,398,924 A * 3/1995 Hiltwein et al. ..... 271/154
5,458,324 A * 10/1995 Nakamura et al. ..... 271/10.02
5,539,510 A 7/1996 Yamashiro et al.
5,555,774 A * 9/1996 Lauring et al. ..... 74/512
5,564,848 A 10/1996 Quintana
5,622,364 A * 4/1997 Dutton et al. ..... 271/117

(Continued)

*Primary Examiner*—Patrick Mackey
*Assistant Examiner*—Jeremy R Severson
(74) *Attorney, Agent, or Firm*—Taylor & Aust

(57) ABSTRACT

An imaging apparatus includes a printing mechanism having a media path. A print media source is provided for supplying a sheet of print media to the printing mechanism. A drive unit is provided, with a drive shaft coupled to the drive unit. A media sensor device is mounted to the drive shaft, wherein as the drive shaft is rotated in a first direction the media sensor device is moved from a first position that is out of the media path to a second position that is in the media path for sensing the sheet of print media. As the drive shaft is rotated in a second direction opposite to the first direction the media sensor device is moved from the second position that is in the media path for sensing the sheet of print media to the first position that is out of the media path.

16 Claims, 4 Drawing Sheets

U.S. PATENT DOCUMENTS 5,743,522 A * 4/1998 Rubscha et al. ..... 271/265.02
5,764,251 A 6/1998 Hashimoto
5,823,529 A * 10/1998 Mandel et al. ..... 271/296
5,842,694 A * 12/1998 Brooks et al. ..... 271/38
5,865,235 A * 2/1999 Krupke et al. ..... 160/191
5,897,112 A * 4/1999 Kwag ..... 271/38
5,962,861 A 10/1999 Fowler
5,988,905 A * 11/1999 Abe et al. ..... 400/613
6,028,318 A 2/2000 Cornelius
6,059,086 A * 5/2000 Studer ..... 192/56.2
6,152,631 A 11/2000 Park
6,154,881 A * 12/2000 Lee ..... 2/9
6,201,255 B1 3/2001 Torchalski et al.
6,206,362 B1 * 3/2001 Tan et al. ..... 271/145
6,308,951 B1 * 10/2001 Allmendinger et al. 271/265.04
6,464,414 B1 10/2002 Washnock
6,572,096 B1 * 6/2003 Johnson et al. ..... 271/25
6,586,759 B1 * 7/2003 Mayo et al. ..... 250/559.4
6,600,167 B2 7/2003 Sano
6,616,136 B1 * 9/2003 Huang et al. ..... 271/10.13
6,651,977 B2 * 11/2003 Tanaka ..... 271/154
6,734,417 B2 * 5/2004 Vejtasa ..... 250/231.13
6,903,358 B2 * 6/2005 Kim ..... 250/559.27
6,914,684 B1 * 7/2005 Bolash et al. ..... 356/600
2004/0041329 A1 * 3/2004 Hiraoka ..... 271/110
2004/0195757 A1 * 10/2004 Lyu et al. ..... 271/110
2005/0036024 A1 * 2/2005 Takagi ..... 347/104
2005/0117010 A1 * 6/2005 Ishii et al. ..... 347/104
2005/0270353 A1 * 12/2005 Nishiberi et al. ..... 347/104

* cited by examiner

IMAGING APPARATUS INCLUDING A MOVABLE MEDIA SENSOR

BACKGROUND OF THE INVENTION

1. Field of the Invention

The present invention relates to an imaging apparatus, and, more particularly, to an imaging apparatus including a movable media sensor.

2. Description of the Related Art

Typically, sensing a media type of a print media works best when the media sensor is in contact with the print media. This has been achieved by placing the media sensor in continuous contact with the input stack of print media. One challenge associated with such a configuration is that the media sensor places an uneven drag on a sheet of the print media and can cause the sheet to skew during printing, thereby causing defects in print quality. Another challenge is that the media sensor housing may scratch the print media, and such a scratch may sometimes show up, for example, as a print defect on certain photo papers.

Printers with a bottom loading input tray have an additional difficulty over top loading input tray printers in regard to media type sensing. Top loading, or L-path, printers typically sense the media type while the paper is in the input tray. With the bottom loading input tray printer, e.g., C-path printer, the print media is placed in the printer upside down, and thus the type of print media cannot be sensed in the input tray since only the backside of the print media is available to be looked at. Previously C-path printers have performed media type sensing with a non-contact sensor, which is less reliable than a contact sensor.

What is needed in the art is an imaging apparatus including a movable media sensor, which may be moved into and out of a media path.

SUMMARY OF THE INVENTION

The present invention provides an imaging apparatus including a movable media sensor, which may be moved into and out of a media path.

The invention, in one form thereof, is directed to an imaging apparatus. The imaging apparatus includes a printing mechanism having a media path. A print media source is provided for supplying a sheet of print media to the printing mechanism. A drive unit is provided, with a drive shaft coupled to the drive unit. A media sensor device is mounted to the drive shaft, wherein as the drive shaft is rotated in a first direction the media sensor device is moved from a first position that is out of the media path to a second position that is in the media path for sensing the sheet of print media. As the drive shaft is rotated in a second direction opposite to the first direction the media sensor device is moved from the second position that is in the media path for sensing the sheet of print media to the first position that is out of the media path.

In another form thereof, the present invention is directed to an imaging apparatus, including a printing mechanism having a media path, a print media source for supplying a sheet of print media to the printing mechanism, a drive system, and a media sensor device mounted to the drive system. The drive system effects a movement of the media sensor device toward a surface of the sheet of print media from a first position that is out of the media path to a second position that is in the media path for sensing the sheet of print media. The drive system effects a movement of the media sensor device away from the surface of the sheet of print media from the second position that is in the media path for sensing the sheet of print media to the first position that is out of the media path.

An advantage of the present invention is that the media sensor may be moved to a sensing position in the media path and then moved to a position out of the media path.

Another advantage is that a contact media sensor may be located in a location other than at the print media source, e.g., input tray, since the media sensor can be positioned clear of the media path as media is being feed to the media sensing point, and thus may be used, for example, both with printers having a top loading media input tray and printers with a bottom loading media input tray.

Another advantage is that a contact media sensor may be used in a manner which will not cause the print media to skew due to uneven drag on the print media, and thus will not negatively affect print quality.

Another advantage is that the ability to move a contact media sensor into and out of the media path produces less of a chance for the contact media sensor to cause scratches on the print media, which may sometimes result in print defects on certain print media, such as for example, photo paper.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
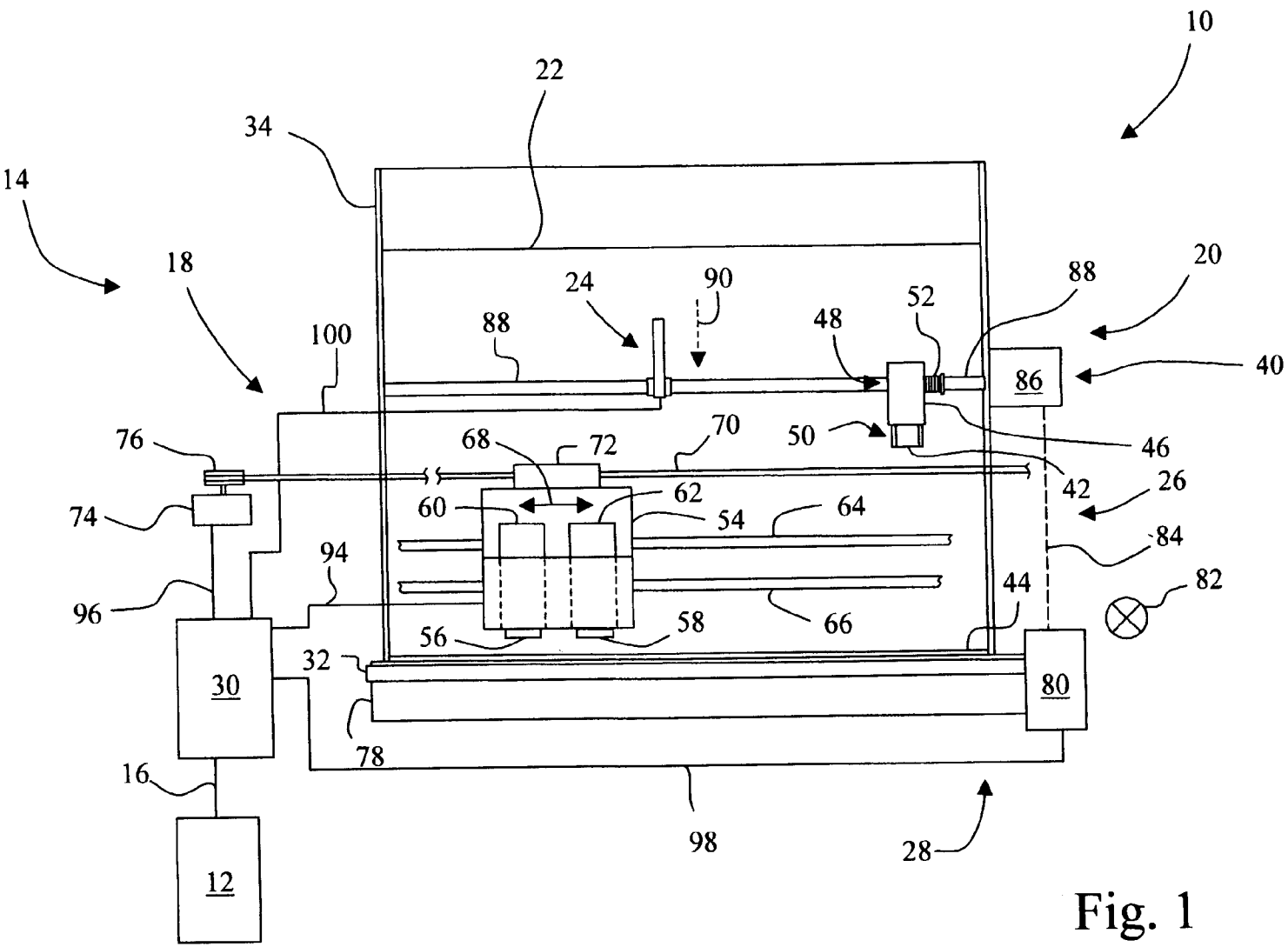
FIG. 1 is a diagrammatic representation of an imaging system including an imaging apparatus embodying the present invention.

Referring now to the drawings, and particularly to FIG. 1, there is shown an imaging system 10 embodying the present invention. Imaging system 10 may include a host 12, or alternatively, imaging system 10 may be a standalone system.

Imaging system 10 includes an imaging apparatus 14, which may be in the form of an ink jet printer, as shown. Thus, for example, imaging apparatus 14 may be a conventional ink jet printer, or may form the print engine for a multi-function apparatus, such as for example, a standalone unit that has faxing and copying capability, in addition to printing.

Host 12, which may be optional, may be communicatively coupled to imaging apparatus 14 via a communications link 16. Communications link 16 may be, for example, a direct electrical connection, a wireless connection, or a network connection.

In embodiments including host 12, host 12 may be, for example, a personal computer including a display device, an input device (e.g., keyboard), a processor, input/output (I/O) interfaces, memory, such as RAM, ROM, NVRAM, and a mass data storage device, such as a hard drive, CD-ROM and/or DVD units. During operation, host 12 includes in its memory a software program including program instructions that function as a printer driver for imaging apparatus 14. The printer driver is in communication with imaging apparatus 14 via communications link 16. The printer driver, for example, includes a halftoning unit and a data formatter that places print data and print commands in a format that can be recognized by imaging apparatus 14. In a network environment, communications between host 12 and imaging apparatus 14 may be facilitated via a standard communication protocol, such as the Network Printer Alliance Protocol (NPAP).

Imaging apparatus 14 includes a printing mechanism 18, a print media source 20 for supplying print media 22 in the form of print media sheets to printing mechanism 18, and a movable media sensor device 24 in accordance with the present invention. Print media 22 may be, for example, plain paper, coated paper, photo paper, transparency media or envelopes, of various sizes.

Printing mechanism 18, when in the form of an ink jet print engine for example, includes a printhead carrier system 26, a feed roller unit 28, a controller 30, and a mid-frame 32. Print media source 20 may include, for example, a top load media tray 34 for holding print media 22, and a sheet feeder mechanism 40 having a sheet picking roller 42. Sheet feeder mechanism 40 may also be referred to in the art as an automatic sheet feed (ASF), or as an autocompensator. Sheet feeder unit 40 includes pivoting arm 46 having a proximal end 48 and a distal end 50, with sheet picking roller 42 being mounted to pivoting arm 46 near distal end 50. A spring 52, such as a torsion spring, is positioned to apply a biasing force to sheet picking roller 42 via pivoting arm 46 toward a sheet of print media 22 located in print media source 20. Thus, for example, sheet picking roller 42 may be located to pick a top sheet 44 of print media 22 located in print media source 20, wherein top sheet 44 of print media 22 is located in media tray 34.

Top sheet 44 is then transported to feed roller unit 28, which in turn further transports top sheet 44 during a printing operation over mid-frame 32, which provides support for top sheet 44 during a printing operation.

In embodiments where printing mechanism 18 is in the form of an ink jet print engine, printhead carrier system 26 includes a printhead carrier 54 for mounting and carrying a printhead 56, e.g., a color printhead, and/or a printhead 58, e.g., a monochrome or photo color printhead. An ink reservoir 60, which may include color inks, is provided in fluid communication with printhead 56. An ink reservoir 62, which may include monochrome ink or photo color inks, is provided in fluid communication with printhead 58. Those skilled in the art will recognize that printhead 56 and ink reservoir 60 may be formed as individual discrete units, or may be combined as an integral unitary printhead cartridge. Likewise, printhead 58 and ink reservoir 62 may be formed as individual discrete units, or may be combined as an integral unitary printhead cartridge.

Printhead carrier 54 is guided by a pair of guide members 64, 66, such as for example, guide rods, which generally define a bi-directional scanning path 68 for printhead carrier 54. Printhead carrier 54 is connected to a carrier transport belt 70 via a carrier drive attachment device 72. Carrier transport belt 70 is driven by a carrier motor 74 via a carrier pulley 76. At the directive of controller 30, printhead carrier 54 is transported in a reciprocating manner along guide members 64, 66. Carrier motor 74 can be, for example, a direct current (DC) motor or a stepper motor.

Feed roller unit 28 includes, for example, a feed roller 78, pinch rollers (not shown) and a drive unit 80. Feed roller 78 is driven by drive unit 80, and the pinch rollers apply a biasing force to hold the media sheet 44 in contact with respective driven feed roller 78. Drive unit 80 includes a drive source, such as for example a direct current (DC) motor, and an associated drive mechanism, such as a gear train or belt/pulley arrangement. Feed roller unit 28 feeds the media sheet 44 in a sheet feed direction 82, designated as an X in a circle in FIG. 1 to indicate that the sheet feed direction is out of the plane of FIG. 1 toward the reader. The sheet feed direction 82 is perpendicular to the horizontal bi-directional scanning path 68. Thus, with respect to media sheet 44, carrier reciprocation occurs in a horizontal direction and media advance occurs in a vertical direction, with respect to the sheet of print media 22, and the carrier reciprocation is generally perpendicular to the media advance direction.

Drive unit 80 may be further used to drive sheet feeder mechanism 40, e.g., rotate sheet picking roller 42, and/or to position movable media sensor device 24. For example, drive unit 80 may be coupled via a transmission device 84 (represented by a dashed line), such as by a belt or gear train, to a drive unit 86. In turn, drive unit 86 is coupled to a drive shaft 88, which in turn supports pivoting arm 46 of sheet feeder mechanism 40, to which sheet picking roller 42 is rotatably attached. Drive shaft 88 is coupled via a gear train (not shown) located in pivoting arm 46 so as to apply a rotational force to sheet picking roller 42.

Further, media sensor device 24 is mounted in a pivoting fashion to drive shaft 88. Drive shaft 88 further supports and drives media sensor device 24 into and out of a media path 90, represented by a dashed arrow, associated with print media 22.

In this arrangement, in order to pick a sheet of print media 22, such as top sheet 44, the motor of drive unit 80 may be rotated in one direction and after media sheet 44 is delivered to feed roller 78, the motor may be reversed to drive feed roller 78 and to cease driving sheet picking roller 42. Alternatively, sheet pick drive unit 86 may include a separate motor as a power source for driving sheet picking roller 42.

Likewise, in this arrangement, in order to position media sensor device 24 in media path 90, e.g., in contact with top sheet 44, the motor of drive unit 80 may rotate drive shaft 88 in one direction, and the motor may be reversed to rotate drive shaft 88 in an opposite direction to remove media sensor device 24 from media path 90, and in turn prevent media sensor device 24 from contacting top sheet 44. Alternatively, media sensor device 24 may include a separate drive shaft and/or motor as a power source for driving media sensor device 24 into and out of media path 90 associated with print media 22.

Controller 30 is electrically connected and communicatively coupled to printheads 56, 58 via a communications link 94, such as for example a printhead interface cable. Controller 30 is electrically connected and communicatively coupled to carrier motor 74 via a communications link 96, such as for example an interface cable. Controller 30 is electrically connected and communicatively coupled to drive unit 80 via a communications link 98, such as for example an interface cable. Controller 30 is electrically connected and communicatively coupled to media sensor device 24 via a communications link 100, such as for example an interface cable.

Controller 30 may be formed as an application specific integrated circuit (ASIC), and includes processing capability, which may be in the form of a microprocessor having an associated random access memory (RAM) and read only memory (ROM). Controller 30 executes program instructions to effect the printing of an image on the media sheet 44, such as for example, by selecting the index feed distance of print media sheet 44 as conveyed by feed roller 78, controlling the reciprocation of printhead carrier 54, and controlling the operations of printheads 56, 58. In addition, controller 30 executes instructions to perform the timely picking of top sheet 44 of print media 22 of print media source 20 using sheet feeder mechanism 40. Further, controller 30 executes instructions to perform media type sensing using media sensor device 24 in a manner in accordance with the present invention.

Figure 2:
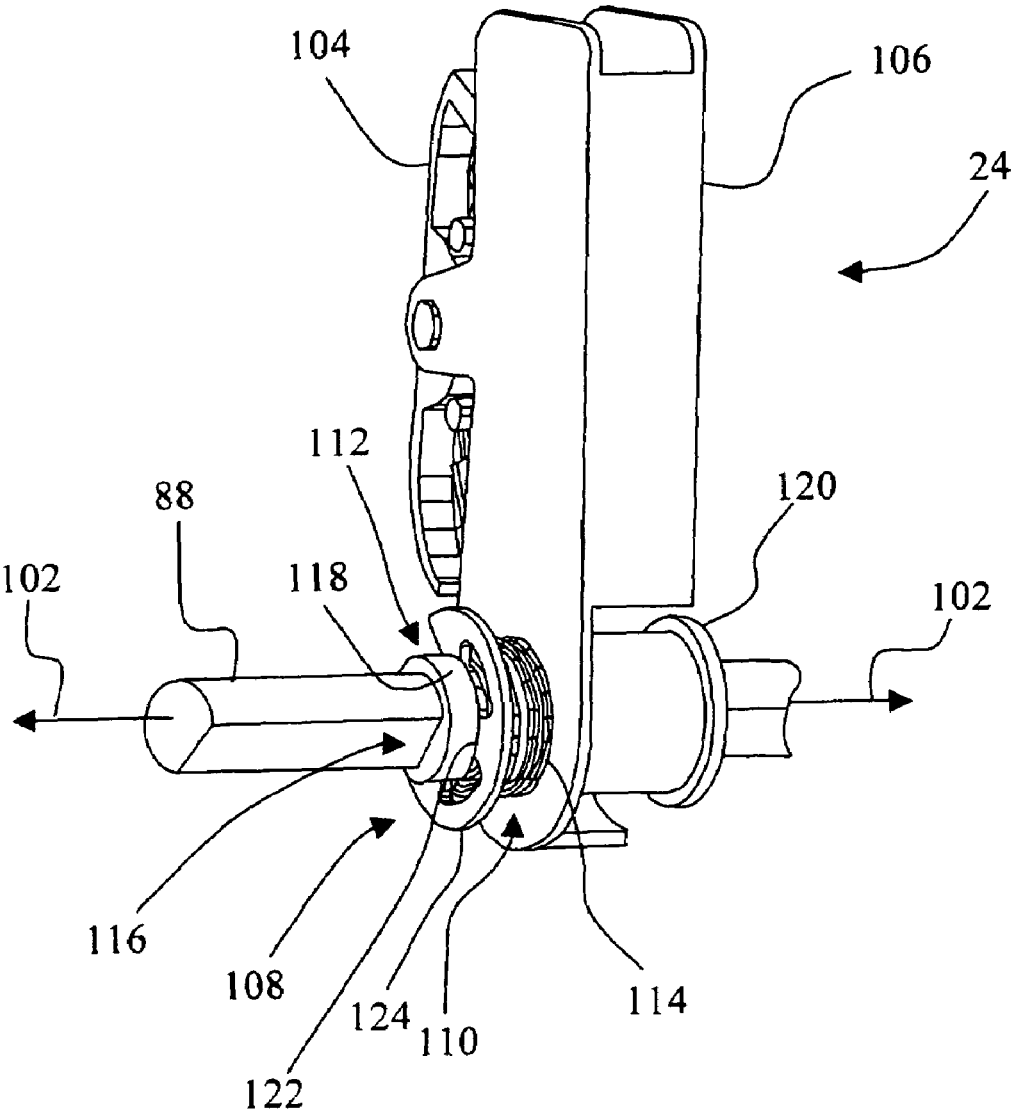
FIG. 2 is a perspective view of the media sensor device included in the imaging apparatus of FIG. 1.

FIG. 2 shows a perspective view of media sensor device 24 that is mounted to drive shaft 88, and is configured such that media sensor device 24 pivots around an axis 102 of drive shaft 88.

Media sensor device 24 includes a sensor 104, an arm 106 and a friction device 108. Sensor 104 is attached to arm 106. Arm 106 has an opening 110 for receiving drive shaft 88. Friction device 108 provides a frictional coupling of arm 106 to drive shaft 88. Friction device 108 may be in the form of a friction-slip clutch configured to produce an axial load along axis 102 of drive shaft 88 to generate friction between arm 106 and drive shaft 88.

Sensor 104 may be, for example, a reflectance sensor. As a reflectance sensor, sensor 104 may be, for example, a unitary optical sensor including at least one light source, such as a light emitting diode (LED), and at least one reflectance detector, such as a phototransistor. The reflectance detector is located on the same side of a media as the light source. The operation of such sensors is well known in the art, and thus, will be discussed herein to the extent necessary to relate the operation of sensor 104 to the operation of the present invention. For example, the LED of sensor 104 directs light at a predefined angle onto a reference surface, such as the surface of a sheet of print media 22, and at least a portion of light reflected from the surface is received by the reflectance detector of sensor 104. The intensity of the reflected light received by the reflectance detector varies with the reflectivity of the print media, and thus can be used by controller 30 in making media type determinations.

Friction device 108 may include a bushing 112 interposed between arm 106 and drive shaft 88, with bushing 112 being mounted to drive shaft 88 for rotation therewith. A spring 114 is interposed between bushing 112 and arm 106.

Bushing 112 has a non-circular opening 116 for receiving drive shaft 88, and may be attached to drive shaft 88, for example, in a pressed fit, or by fasteners or snap rings. At least a portion of drive shaft 88 has a profile in cross-section corresponding to non-circular opening 116. For example, FIG. 2 shows non-circular opening 116 is a D-shaped opening.

Bushing 112 includes a body 118, a shoulder 120, a perimetrical groove 122, and a retainer 124. Shoulder 120 is located on one end of body 118, and perimetrical groove 122 is located near an opposite end of body 118. Retainer 124 serves as a secondary shoulder that extends radially from body 118, with respect to axis 102. Retainer 124 may be, for example, a snap ring that engages perimetrical groove 122 of body 118. Alternatively, shoulder 120 and/or retainer 124 may be attached directly to drive shaft 88.

Spring 114 may be, for example, a coil spring that is positioned around drive shaft 88, and more particularly around a portion of body 118 of bushing 112. Accordingly, retainer 124 serves as a secondary shoulder for retaining spring 114 and arm 106, with spring 114 being interposed between retainer 124 and arm 106.

Thus, spring 114 is maintained in a state of compression between retainer 124 of bushing 112 and arm 106, thereby generating a frictional force as between bushing 112 and arm 106, such that arm 106 will pivot with a rotation of drive shaft 88 until the frictional force is overcome. Stated in another way, since spring 114 pushes arm 106 against shoulder 120 of bushing 112 and bushing 112 turns with drive shaft 88, as drive shaft 88 turns there is always a torque on arm 106 that is in the direction of rotation of drive shaft 88. As long as this torque is greater than any resistive torque, media sensor device 24 will pivot in the direction of rotation of drive shaft 88.

Figure 3:
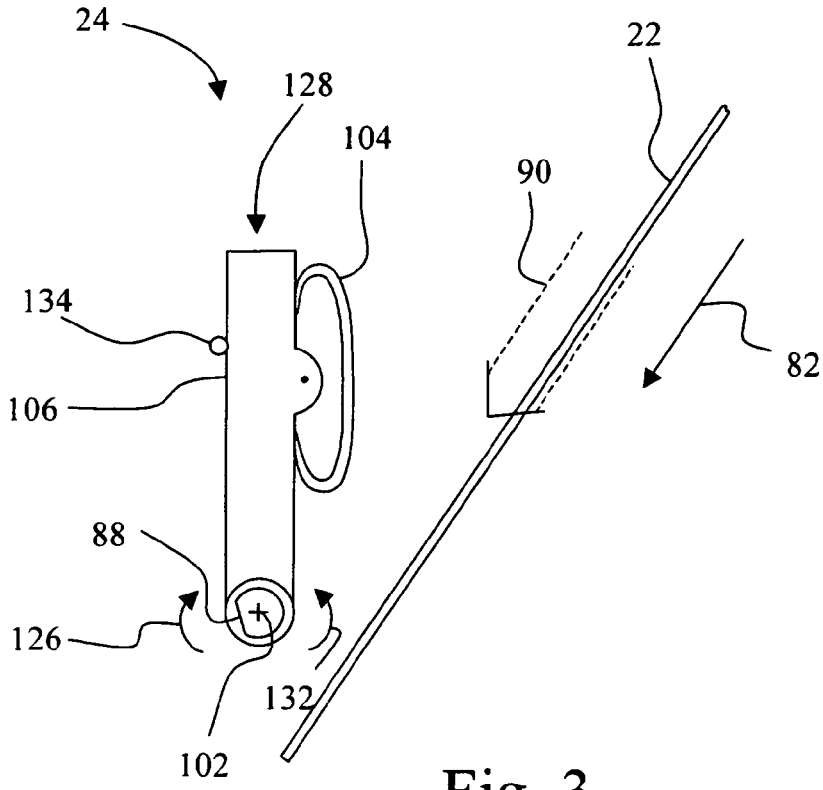
FIG. 3 is a diagrammatic representation of the media sensor device of FIG. 2 in a position outside a media path.
Figure 4:
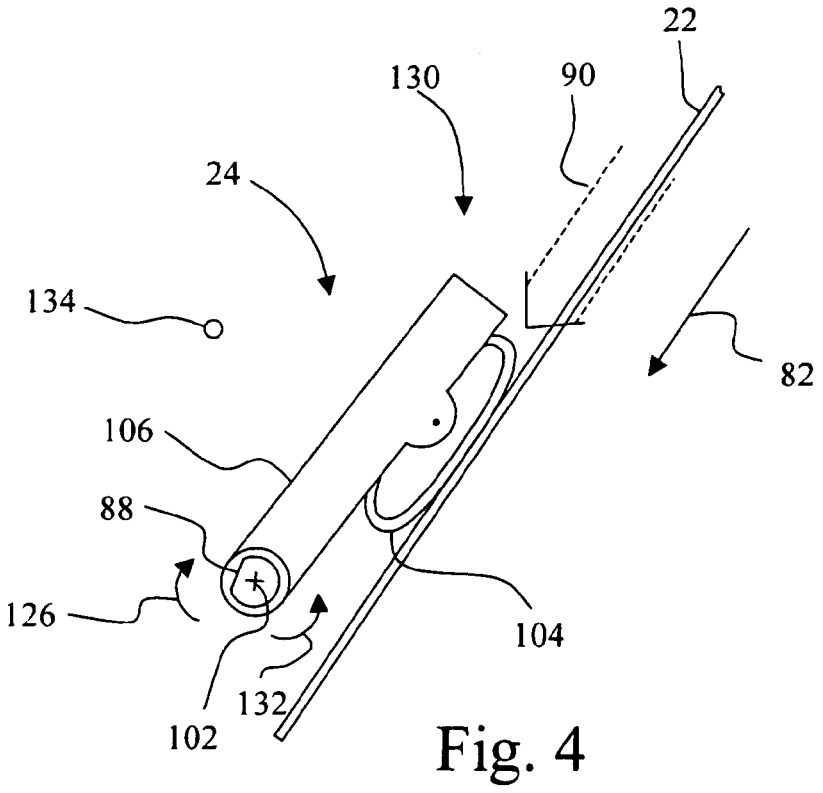
FIG. 4 is a diagrammatic representation of the media sensor device of FIG. 2 in a position in the media path, and in contact with a sheet of print media.

Referring to FIGS. 3 and 4, during operation, as drive shaft 88 is rotated in a first direction 126, media sensor device 24 is moved from a first position 128 that is out of the media path 90 to a second position 130 that is in media path 90 for sensing the sheet of print media 22. Accordingly, media sensor device 24 is moved toward the surface of the sheet of print media 22 until sensor 104 contacts the sheet of print media 22, although drive shaft 88 may continue rotation in first direction 126 after contact is made by virtue of friction device 108 operating as a slip clutch. In one embodiment, during media type sensing, the sheet of print media 22 may be held stationary, so as to not create friction between the sheet of print media 22 and sensor 104 in sheet feed direction 82, and thereby avoiding damage to a surface of the sheet of print media 22.

To retract media sensor device 24 out of contact with media sensor device 24 and out of media path 90, drive shaft 88 is rotated in second direction 132 opposite to first direction 126, so that media sensor device 24 is moved from second position 130 that is in media path 90 for sensing the sheet of print media 22 to first position 128 that is out of media path 90. As shown in FIG. 3, a stop 134 is provided to limit the extent that arm 106 is permitted to pivot about axis 102 as drive shaft 88 is rotated in second direction 132. Accordingly, media sensor device 24 is moved away from the surface of the sheet of print media 22 until arm 106 of media sensor device 24 contacts stop 134, although drive shaft 88 may continue rotation in second direction 132 after contact is made by virtue of friction device 108 operating as a slip clutch.

Figure 5:
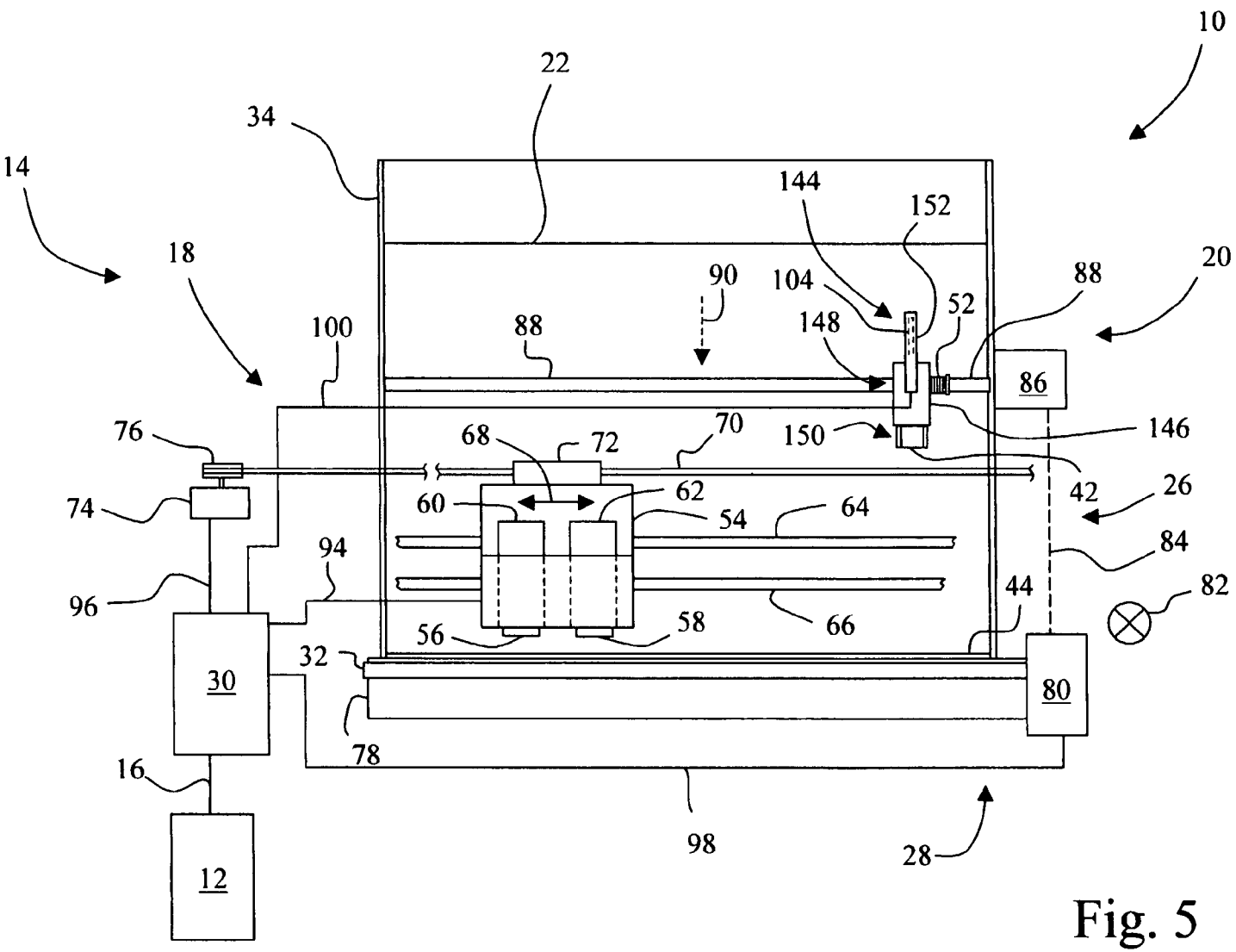
FIG. 5 is a diagrammatic representation of an imaging system including another embodiment of a media sensor device configured in accordance with the present invention.

FIG. 5 shows an alternative embodiment, wherein the media sensor device is combined with the sheet feeder mechanism. In this embodiment, there is shown a media sensor device 144 that includes an arm 146 having a proximal end 148 and a distal end 150. Arm 146 is pivotably mounted to drive shaft 88, such as for example, in the same manner as pivoting arm 46 of sheet feeder mechanism 40 of FIG. 1. Sheet picking roller 42 is mounted to arm 146 near distal end 150 of arm 146. An extension 152 may protrude from arm 146 for mounting sensor 104, or alternatively, sensor 104 may be mounted directly to arm 146. In this embodiment, sheet picking roller 42 is driven by drive shaft 88, and both sheet picking roller 42 and sensor 104 are positioned by the change of position of arm 146 based on a rotation of drive shaft 88.

While this invention has been described with respect to exemplary embodiments, the present invention can be further modified within the spirit and scope of this disclosure. For example, while the exemplary embodiments described above depict the present invention in association with an imaging apparatus having a top loading input tray, such as an imaging apparatus having an L-shaped media path, those skilled in the art will recognize that the present invention may be used with an imaging apparatus having a bottom loading input tray, such as an imaging apparatus having a C-shaped media path. Further, those skilled in the art will recognize that the media sensor device of the present invention is not limited to being locating in the media input tray, but rather, if desired, the media sensor device may be located at another location along the media path that is not in the input tray. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An imaging apparatus, comprising:

a printing mechanism having a media path;

a print media source for supplying a sheet of print media to said printing mechanism;

a drive unit;

a drive shaft coupled to said drive unit; and a media sensor device having an optical sensor configured for making a media type determination mounted to said drive shaft, wherein as said drive shaft is rotated in a first direction said media sensor device is moved from a first position that is out of the media path to a second position that is in said media path for sensing said sheet of print media, and as said drive shaft is rotated in a second direction opposite to said first direction said media sensor device is moved from said second position that is in said media path for sensing said sheet of print media to said first position that is out of the media path.

2. The imaging apparatus of claim 1, wherein said media sensor device pivots around an axis of said drive shaft.

3. The imaging apparatus of claim 1, wherein said media sensor device comprises:

an arm having an opening for receiving said drive shaft; and a friction device for providing a frictional coupling of said arm to said drive shaft, wherein said optical sensor is attached to said arm.

4. The imaging apparatus of claim 3, wherein said friction device is a friction-slip clutch configured to produce an axial load along an axis of said drive shaft to generate friction between said arm and said drive shaft.

5. The imaging apparatus of claim 3, wherein said friction device comprises:

a bushing interposed between said arm and said drive shaft, said bushing being mounted to said drive shaft for rotation therewith; and a spring interposed between said bushing and said arm.

6. The imaging apparatus of claim 5, wherein said spring is a coil spring that is positioned around said drive shaft.

7. The imaging apparatus of claim 6, wherein said bushing includes a retainer, said spring being interposed between said retainer and said arm.

8. An imaging apparatus, comprising:

a printing mechanism having a media path;

a print media source for supplying a sheet of print media to said printing mechanism;

a drive unit;

a drive shaft coupled to said drive unit; and a media sensor device configured for making a media type determination mounted to said drive shaft, wherein as said drive shaft is rotated in a first direction said media sensor device is moved from a first position that is out of the media path to a second position that is in said media path for sensing said sheet of print media, and as said drive shaft is rotated in a second direction opposite to said first direction said media sensor device is moved from said second position that is in said media path for sensing said sheet of print media to said first position that is out of the media path, wherein said media sensor device comprises:

an arm having an opening for receiving said drive shaft;

a friction device for providing a frictional coupling of said arm to said drive shaft; and a sensor attached to said arm, wherein said friction device comprises:

a bushing interposed between said arm and said drive shaft, said bushing being mounted to said drive shaft for rotation therewith; and a spring interposed between said bushing and said arm, wherein said bushing has a non-circular opening for receiving said drive shaft, and drive shaft has a profile in cross-section corresponding to said non-circular opening.

9. The imaging apparatus of claim 8, wherein said non-circular opening is a D-shaped opening.

10. An imaging apparatus, comprising:

a printing mechanism having a media path;

a print media source for supplying a sheet of print media to said printing mechanism;

a drive unit;

a drive shaft coupled to said drive unit; and a media sensor device configured for making a media type determination mounted to said drive shaft, wherein as said drive shaft is rotated in a first direction said media sensor device is moved from a first position that is out of the media path to a second position that is in said media path for sensing said sheet of print media, and as said drive shaft is rotated in a second direction opposite to said first direction said media sensor device is moved from said second position that is in said media path for sensing said sheet of print media to said first position that is out of the media path, wherein said media sensor device comprises:

an arm having an opening for receiving said drive shaft;

a friction device for providing a frictional coupling of said arm to said drive shaft; and a sensor attached to said arm, wherein said friction device comprises:

a bushing interposed between said arm and said drive shaft, said bushing being mounted to said drive shaft for rotation therewith; and a spring interposed between said bushing and said arm, wherein said spring is a coil spring that is positioned around said drive shaft;

wherein said bushing includes a retainer, said spring being interposed between said retainer and said arm; and wherein said retainer is a shoulder that extends radially from a body of said bushing.

11. The imaging apparatus of claim 10, wherein said shoulder is a snap ring that engages said body of said bushing.

12. An imaging apparatus, comprising:

a printing mechanism having a media path;

a print media source for supplying a sheet of print media to said printing mechanism;

a drive unit;

a drive shaft coupled to said drive unit; and a media sensor device configured for making a media type determination mounted to said drive shaft, wherein as said drive shaft is rotated in a first direction said media sensor device is moved from a first position that is out of the media path to a second position that is in said media path for sensing said sheet of print media, and as said drive shaft is rotated in a second direction opposite to said first direction said media sensor device is moved from said second position that is in said media path for sensing said sheet of print media to said first position that is out of the media path, said media sensor device comprising:

an arm having a proximal end and a distal end, said arm being pivotably mounted to said drive shaft;

a sheet picking roller mounted to said arm near said distal end of said arm, said sheet picking roller being driven by said drive shaft; and a media sensor mounted to said arm.

13. An imaging apparatus, comprising:

a printing mechanism having a media path;

a print media source for supplying a sheet of print media to said printing mechanism;

a drive system; and a media sensor device having an optical sensor configured for making a media type determination mounted to said drive system, said drive system effecting a movement of said media sensor device toward a surface of said sheet of print media from a first position that is out of the media path to a second position that is in said media path for sensing said sheet of print media, and said drive system effecting a movement of said media sensor device away from said surface of said sheet of print media from said second position that is in said media path for sensing said sheet of print media to said first position that is out of the media path.

14. The imaging apparatus of claim 13, wherein said drive system comprises:

a drive unit; and a drive shaft coupled to said drive unit.

15. The imaging apparatus of claim 14, wherein said media sensor device is mounted to said drive shaft.

16. The imaging apparatus of claim 15, wherein as said drive shaft is rotated in a first direction said media sensor device is moved from said first position that is out of the media path to said second position that is in said media path for sensing said sheet of print media, and as said drive shaft is rotated in a second direction opposite to said first direction said media sensor device is moved from said second position that is in said media path for sensing said sheet of print media to said first position that is out of the media path.

* * * * *